US011029005B1

(12) United States Patent
Hsu

(10) Patent No.: US 11,029,005 B1
(45) Date of Patent: Jun. 8, 2021

(54) LIGHTING FIXTURE ASSEMBLED AND DISASSEMBLED QUICKLY

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/856,105

(22) Filed: Apr. 23, 2020

(51) Int. Cl.
*F21V 21/03* (2006.01)
*F21S 8/04* (2006.01)

(52) U.S. Cl.
CPC ..... *F21V 21/03* (2013.01); *F21S 8/043* (2013.01)

(58) Field of Classification Search
CPC ..... F21V 21/044; F21V 21/045; F21V 21/03; F21S 8/043; F21S 8/061; F21Y 2105/00; F21Y 2115/10
See application file for complete search history.

(56) References Cited

U.S. PATENT DOCUMENTS

| | | | | |
|---|---|---|---|---|
| 4,104,713 | A * | 8/1978 | Chan | F21S 8/04 362/294 |
| 4,645,289 | A * | 2/1987 | Isban | H02G 3/20 439/101 |
| 6,146,191 | A * | 11/2000 | Kerr, Jr. | H02G 3/123 439/537 |
| 9,702,533 | B1 * | 7/2017 | Harpenau | F21V 21/03 |
| 10,731,830 | B2 * | 8/2020 | Feit | F21S 8/036 |
| 10,816,150 | B1 * | 10/2020 | Hsu | F21S 8/043 |
| 2002/0118545 | A1 * | 8/2002 | Bucher | F21V 21/03 362/404 |
| 2013/0292149 | A1 * | 11/2013 | Cooper | H02G 3/14 174/44 |
| 2017/0227195 | A1 * | 8/2017 | Feit | F21S 8/036 |
| 2020/0080709 | A1 * | 3/2020 | Boulanger | F21V 21/03 |

* cited by examiner

*Primary Examiner* — Leah Simone Macchiarolo
(74) *Attorney, Agent, or Firm* — Karin L. Williams; Alan D. Kamrath; Mayer & Williams PC

(57) ABSTRACT

A lighting fixture includes a top plate, a crossbeam, a lamp body, and a connecting member. The crossbeam is mounted on the top plate and includes a support portion and two fixed portions. The support portion is arranged between the fixed portions and has two abutting sections. The connecting member is mounted on the lamp body and is detachably connected with the crossbeam. The connecting member includes two locking portions each formed with a clamping section and a retaining section located under the clamping section. When the connecting member is pushed toward the crossbeam, the support portion passes the clamping section, and each of the abutting sections is locked into and retained by the respective retaining section.

9 Claims, 4 Drawing Sheets

LIGHTING FIXTURE ASSEMBLED AND DISASSEMBLED QUICKLY

BACKGROUND OF THE INVENTION

1. Field of the Invention

The present invention relates to an illuminating apparatus and, more particularly, to a lighting fixture for a ceiling lamp.

2. Description of the Related Art

A conventional ceiling lamp comprises a first connecting module and a second connecting module. The first connecting module is secured to the ceiling. The second connecting module is secured to a lighting module. The second connecting module is combined with the first connecting module, to attach the lighting module to the ceiling. However, the second connecting module is combined with the first connecting module by soldering or screwing, such that the second connecting module cannot be detached from the first connecting module easily and conveniently, thereby causing inconvenience to the user when having to replace the lighting module.

BRIEF SUMMARY OF THE INVENTION

The primary objective of the present invention is to provide a lighting fixture that is assembled and disassembled quickly.

In accordance with the present invention, there is provided a lighting fixture comprising a top plate, a crossbeam, a lamp body, and a connecting member. The crossbeam is mounted on the top plate and includes a support portion and two fixed portions. The support portion is arranged between the two fixed portions and has two abutting sections. Each of the two abutting sections extends upward from the support portion. The connecting member is mounted on the lamp body and is detachably connected with the crossbeam, such that the lamp body is attached to the crossbeam by the connecting member. The connecting member includes two locking portions. Each of the two locking portions has a middle formed with a clamping section. The clamping section is bent inward. Each of the two locking portions is formed with a retaining section located under the clamping section. The retaining section is bent outward. When the connecting member is pushed toward the crossbeam, the support portion of the crossbeam passes the clamping section of the connecting member, and each of the two abutting sections is locked into and retained by the respective retaining section of the connecting member.

According to the primary advantage of the present invention, the connecting member is locked onto or unlocked from the crossbeam easily and quickly, such that the lamp body is mounted on or detached from the top plate conveniently, thereby facilitating the user mounting or replacing the lamp body.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
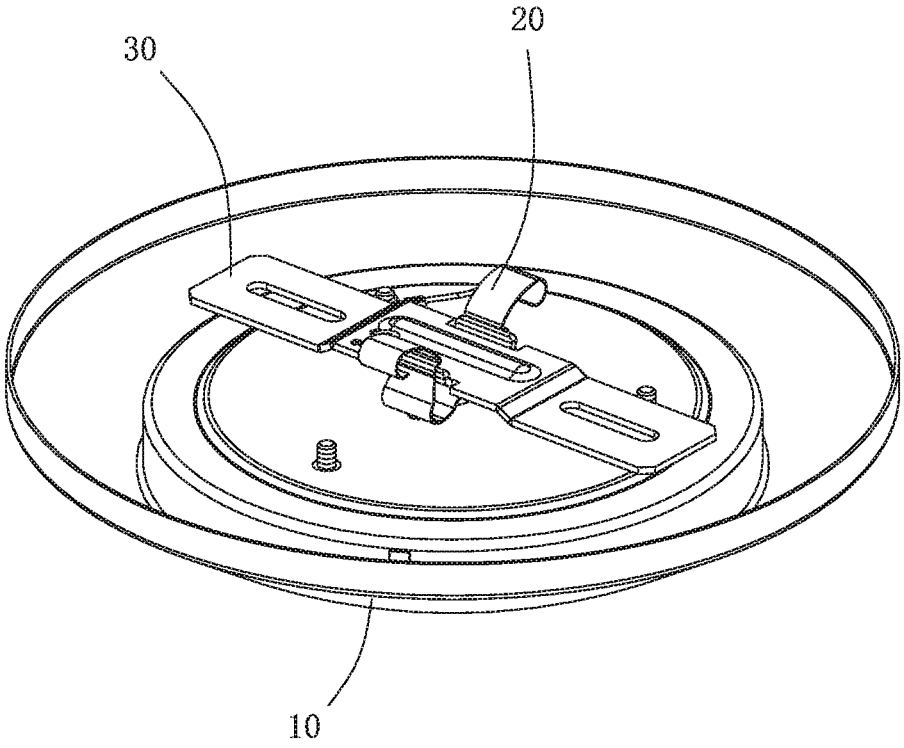
FIG. 1 is a partial perspective view of a lighting fixture in accordance with the preferred embodiment of the present invention.
Figure 2:
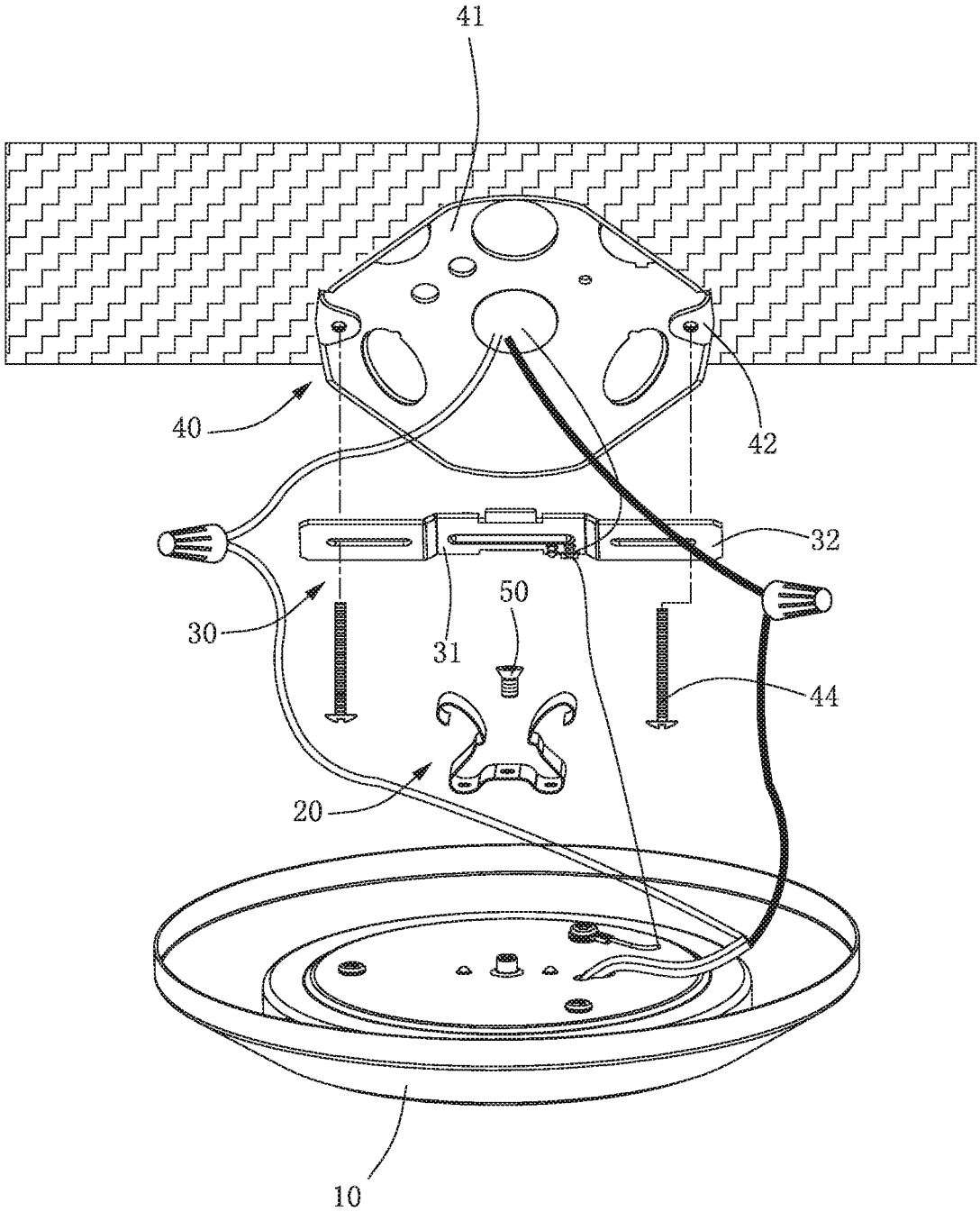
FIG. 2 is a partial exploded perspective view of the lighting fixture in accordance with the preferred embodiment of the present invention.
Figure 3:
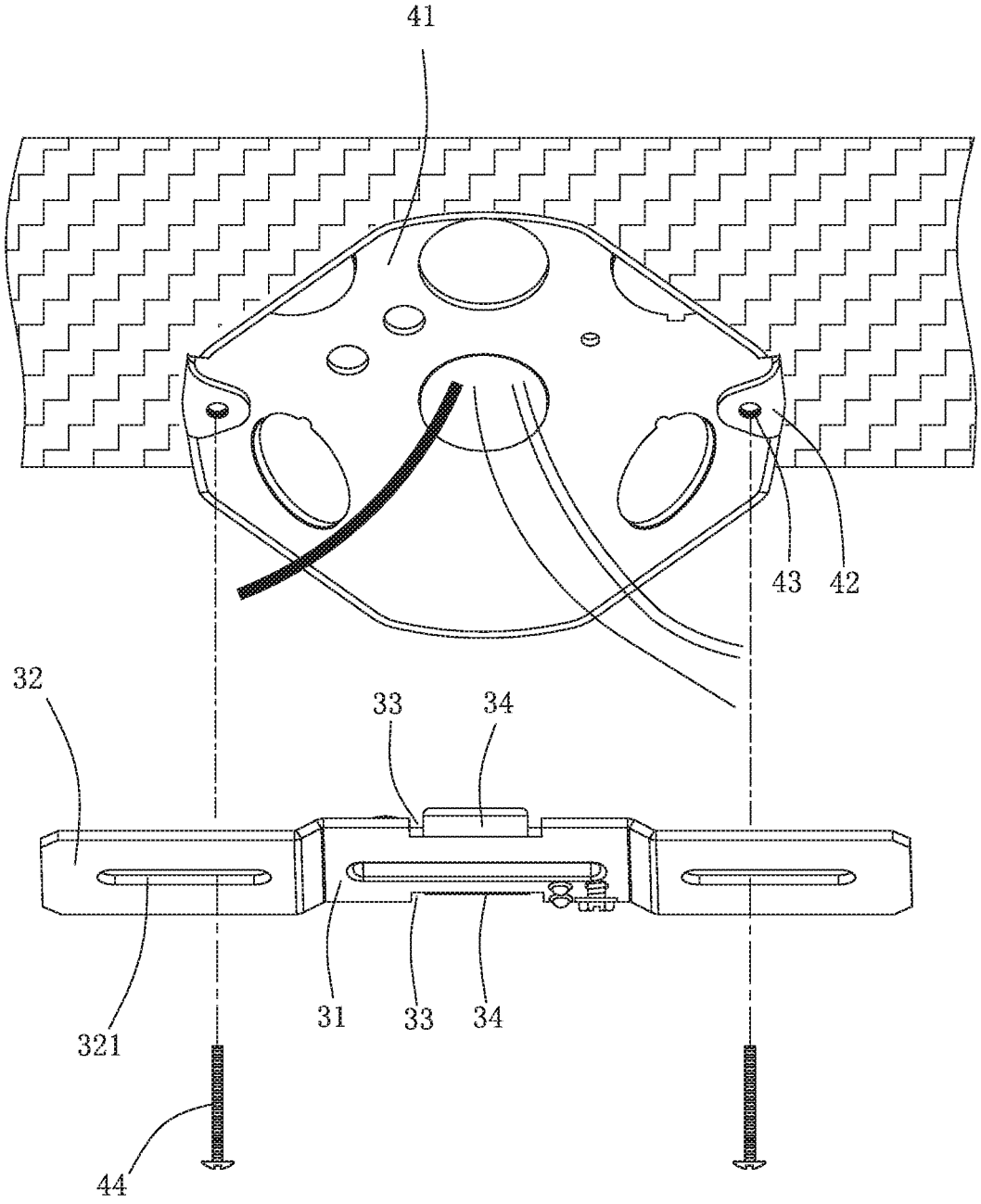
FIG. 3 is a locally enlarged view of the lighting fixture as shown in FIG. 2.
Figure 4:
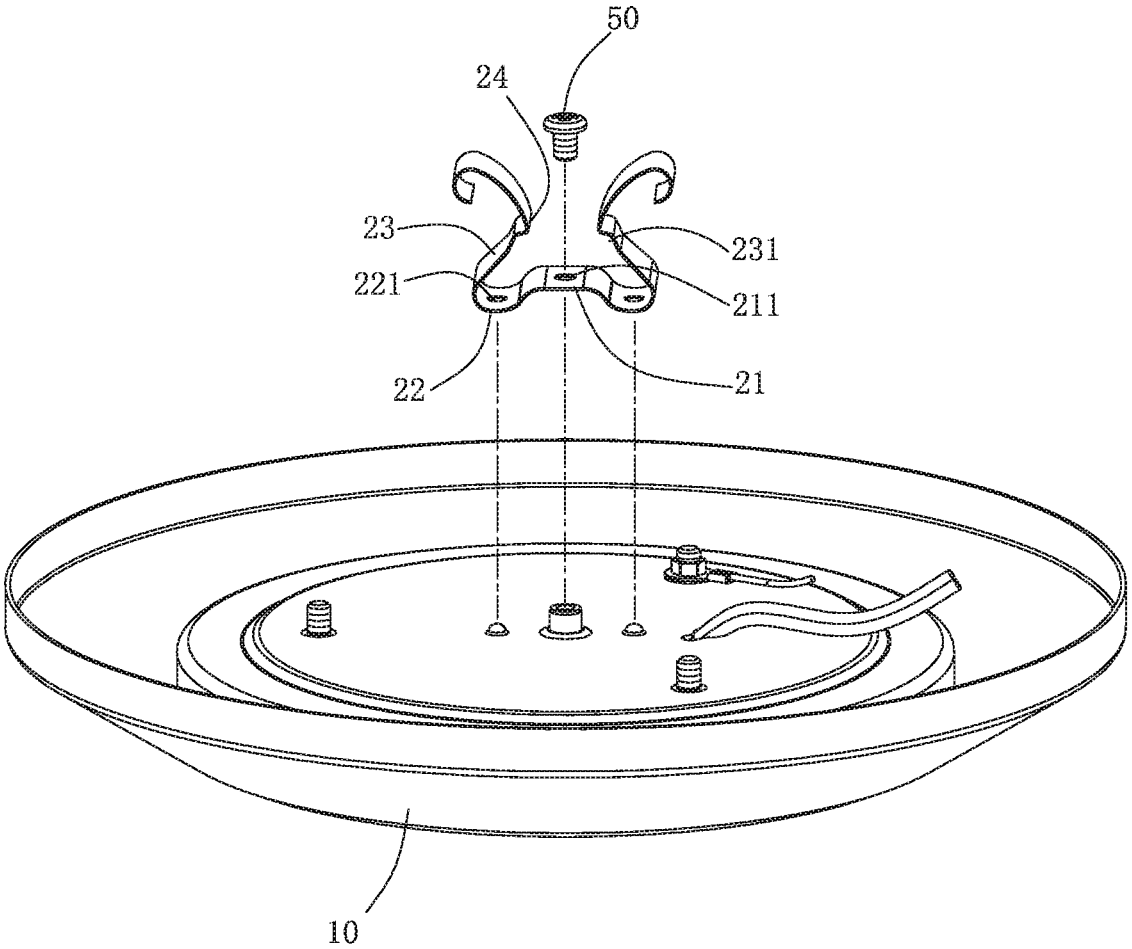
FIG. 4 is another locally enlarged view of the lighting fixture as shown in FIG. 2.

Referring to FIGS. 1-4, a lighting fixture in accordance with the preferred embodiment of the present invention comprises a top plate 40, a crossbeam (or support plate or transverse piece) 30, a lamp body 10, and a connecting member 20.

The crossbeam 30 is transversely mounted on the top plate 40 and includes a support portion 31 and two fixed portions 32. The support portion 31 is arranged between the two fixed portions 32 and has two abutting sections 34. Each of the two abutting sections 34 extends upward from the support portion 31.

The connecting member 20 is mounted on the lamp body 10 and is detachably connected with the crossbeam 30, such that the lamp body 10 is attached to the crossbeam 30 by the connecting member 20. The connecting member 20 includes two locking portions 23. Each of the two locking portions 23 has a middle formed with a clamping section 24. The clamping section 24 is bent inward. Each of the two locking portions 23 is formed with a retaining section 231 located under the clamping section 24. The retaining section 231 is bent outward and forms an opening.

In practice, when the connecting member 20 is pushed toward the crossbeam 30, the support portion 31 of the crossbeam 30 passes the clamping section 24 of the connecting member 20, and each of the two abutting sections 34 is locked into and retained by the respective retaining section 231 of the connecting member 20, such that the connecting member 20 is locked onto the crossbeam 30.

In the preferred embodiment of the present invention, the top plate 40 includes a main portion 41 and two ears 42. Each of the two ears 42 is bent and extends inward from a periphery of the top plate 40. Each of the two ears 42 is provided with a mounting hole 43. Each of the two fixed portions 32 is provided with a locking slot 321. The lighting fixture further comprises two fastening members 44 each extending through the locking slot 321 of each of the two fixed portions 32 and each secured in the mounting hole 43 of each of the two ears 42, to attach the crossbeam 30 to the top plate 40. Preferably, the mounting hole 43 of each of the two ears 42 is a screw hole, and each of the two fastening members 44 is a screw.

In the preferred embodiment of the present invention, the support portion 31 is located between the two ears 42.

In the preferred embodiment of the present invention, the support portion 31 has two sides each having a middle formed with a groove 33, and each of the two abutting sections 34 extends upward from a bottom of the respective groove 33. Thus, the width of the crossbeam 30 is reduced by provision of the groove 33.

In the preferred embodiment of the present invention, the connecting member 20 includes a first securing portion 21 and two second securing portion 22. The first securing portion 21 is located between the two second securing portion 22.

In the preferred embodiment of the present invention, each of the two second securing portion 22 has a first end connected with the first securing portion 21 and a second end connected with one of the two locking portions 23. The second end of each of the two second securing portion 22 has an arcuate shape and extends upward. Each of the two locking portions 23 has a first end connected with one of the two second securing portion 22 and an arcuate second end that is bent and extends outward.

In the preferred embodiment of the present invention, the lighting fixture further comprises a plurality of fasteners 50 extending through the connecting member 20 and secured in the lamp body 10 to attach the connecting member 20 to the lamp body 10. The first securing portion 21 is provided with a first through hole 211 allowing passage of one of the fasteners 50. Each of the two second securing portion 22 is provided with a second through hole 221 allowing passage of one of the fasteners 50.

In the preferred embodiment of the present invention, the first securing portion 21 has two arcuate ends each extending downward and each connected with one of the two second securing portion 22. The first securing portion 21 has a bottom provided with an evading space or a receiving space.

In the preferred embodiment of the present invention, the support portion 31 has an inverted U-shaped configuration, and a height differential is defined between the support portion 31 and each of the two fixed portions 32.

In the preferred embodiment of the present invention, the connecting member 20 is made of a metallic piece with greater elasticity.

In assembly, the crossbeam 30 is mounted on the top plate 40, with the support portion 31 being located between the two ears 42, and with the two fixed portions 32 aligning with the two ears 42. At this time, the locking slot 321 of each of the two fixed portions 32 and each secured in the mounting hole 43 of each of the two ears 42. Then, each of the two fastening members 44 extends through the locking slot 321 of each of the two fixed portions 32 and screwed into the mounting hole 43 of each of the two ears 42, to affix the crossbeam 30 to the top plate 40. On the other hand, the connecting member 20 is mounted on the lamp body 10. Then, the fasteners 50 extend through the first through hole 211 and the second through hole 221 and are screwed into the lamp body 10, to affix the connecting member 20 to the lamp body 10. When the lamp body 10 is pushed upward toward the top plate 40, the connecting member 20 is pushed to press the crossbeam 30. In such a manner, the two locking portions 23 are pressed by the two abutting sections 34 and are expanded outward to produce a restoring force. After the support portion 31 passes the clamping section 24 of each of the two locking portions 23, the two locking portions 23 are contracted inward by the restoring force, such that each of the two abutting sections 34 is locked into and retained by the respective retaining section 231 of the connecting member 20. Thus, the connecting member 20 is locked onto the crossbeam 30 to attach the lamp body 10 to the crossbeam 30.

On the contrary, when the lamp body 10 is pulled away from the top plate 40, the connecting member 20 is pulled away from the crossbeam 30. In such a manner, the two locking portions 23 are pressed by the two abutting sections 34 and are expanded outward such that each of the two abutting sections 34 is released from the respective retaining section 231 of the connecting member 20, and the support portion 31 passes the clamping section 24 of each of the two locking portions 23, to detach the connecting member 20 from the crossbeam 30. Thus, the connecting member 20 is unlocked from the crossbeam 30 to detach the lamp body 10 from the crossbeam 30.

Accordingly, the connecting member 20 is locked onto or unlocked from the crossbeam 30 easily and quickly, such that the lamp body 10 is mounted on or detached from the top plate 40 conveniently, thereby facilitating the user mounting or replacing the lamp body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A lighting fixture comprising:

a top plate, a crossbeam, a lamp body, and a connecting member;

wherein:

the crossbeam is mounted on the top plate and includes a support portion and two fixed portions;

the support portion is arranged between the two fixed portions and has two abutting sections;

each of the two abutting sections extends upward from the support portion;

the connecting member is mounted on the lamp body and is detachably connected with the crossbeam, such that the lamp body is attached to the crossbeam by the connecting member;

the connecting member includes two locking portions;

each of the two locking portions has a middle formed with a clamping section;

the clamping section is bent inward;

each of the two locking portions is formed with a retaining section located under the clamping section;

the retaining section is bent outward;

when the connecting member is pushed toward the crossbeam, the support portion of the crossbeam passes the clamping section of the connecting member, and each of the two abutting sections is locked into and retained by the respective retaining section of the connecting member.

2. The lighting fixture as claimed in claim 1, wherein:

the top plate includes a main portion and two ears;

each of the two ears is bent and extends inward from a periphery of the top plate;

each of the two ears is provided with a mounting hole;

each of the two fixed portions is provided with a locking slot; and the lighting fixture further comprises two fastening members each extending through the locking slot of each of the two fixed portions and each secured in the mounting hole of each of the two ears, to attach the crossbeam to the top plate.

3. The lighting fixture as claimed in claim 1, wherein the support portion is located between the two ears.

4. The lighting fixture as claimed in claim 1, wherein the support portion has two sides each having a middle formed with a groove, and each of the two abutting sections extends upward from a bottom of the respective groove.

5. The lighting fixture as claimed in claim 1, wherein:

the connecting member includes a first securing portion and two second securing portion; and the first securing portion is located between the two second securing portion.

6. The lighting fixture as claimed in claim 5, wherein:

each of the two second securing portion has a first end connected with the first securing portion and a second end connected with one of the two locking portions;

the second end of each of the two second securing portion has an arcuate shape and extends upward; and each of the two locking portions has a first end connected with one of the two second securing portion and an arcuate second end that is bent and extends outward.

7. The lighting fixture as claimed in claim 5, further comprising:

a plurality of fasteners extending through the connecting member and secured in the lamp body to attach the connecting member to the lamp body;

wherein:

the first securing portion is provided with a first through hole allowing passage of one of the fasteners; and each of the two second securing portion is provided with a second through hole allowing passage of one of the fasteners.

8. The lighting fixture as claimed in claim 5, wherein:

the first securing portion has two arcuate ends each extending downward and each connected with one of the two second securing portion; and the first securing portion has a bottom provided with an evading space.

9. The lighting fixture as claimed in claim 1, wherein the support portion has an inverted U-shaped configuration, and a height differential is defined between the support portion and each of the two fixed portions.

* * * * *